US005615662A

United States Patent [19]

Tentler et al.

[11] Patent Number: 5,615,662

[45] Date of Patent: Apr. 1, 1997

[54] CONTINUOUS LOOP WRIST STRAP FOR BOW STRING RELEASE

[75] Inventors: Lynn A. Tentler, Fond Du Lac; Louis R. Linsmeyer, Hustisford, both of Wis.

[73] Assignee: Tru-Fire Corporation, North Fond Du Lac, Wis.

[21] Appl. No.: 285,993

[22] Filed: Aug. 4, 1994

Related U.S. Application Data

[63] Continuation-in-part of Ser. No. 979,106, Nov. 20, 1992, Pat. No. 5,357,939.

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 3,028,852 | 4/1962 | Sutton | 124/35.2 |
| 3,072,115 | 1/1963 | Johnson | 124/35.2 |
| 3,604,407 | 9/1971 | Wilson et al. | 124/35.2 |
| 4,426,989 | 1/1984 | Sutton | 124/35.2 |
| 4,509,497 | 4/1985 | Garvison | 124/35.2 |
| 4,909,232 | 3/1990 | Carella | 124/35.2 |
| 4,969,448 | 11/1990 | Beyer | 124/35.2 |
| 5,020,508 | 6/1991 | Greene | 124/35.2 |

*Primary Examiner*—John A. Ricci

*Attorney, Agent, or Firm*—Robert C. Curfiss; Mark A. Tidwell; Butler & Binion

[57] ABSTRACT

A strap mechanism is adapted to form a continuous loop wrist strap for facilitating quick attachment and detachment of the strap to the wrist. The distance between the release and the strap is adjustable to permit adaptation of the release and strap to varying size hands. The release is adapted to be movable relative to the release body without the use of spherical bearing elements. The head of the release is both rotatable and tiltable relative to the strap.

19 Claims, 4 Drawing Sheets

CONTINUOUS LOOP WRIST STRAP FOR BOW STRING RELEASE

CROSS REFERENCE TO RELATED APPLICATION

This application is a continuation-in-part of application Ser. No. 07/979,106, filed Nov. 20, 1992, now U.S. Pat. No. 5,357,939.

BACKGROUND OF INVENTION

1. Field of Invention

The invention is generally related to bow string releases and is specifically directed to a release having a continuous loop wrist strap.

2. Description of the Prior Art

Bow string releases are well known in the industry. Typically, a bow string release is designed to engage and lock a bow string in a mechanical sear for allowing the archer to pull the bow to its maximum draw. A trigger mechanism is then used to unlock the sear mechanism and release the string to fire the arrow.

There are numerous sear mechanisms available ranging from ball type releases as shown in U.S. Pat. No. 4,403,584 entitled: Bow String Release, issued to Todd on Sep. 13, 1983, and U.S. Pat. No. 4,476,845 entitled: Archery Bow-string Releasing Device, issued to Rickard on Oct. 16, 1984 to various jaw-type releases which have been available for many years. Each of the bow string release mechanisms utilizes a trigger release in order to disengage the sear or permitting the string to be released for firing the arrow.

Typically, trigger mechanisms operate in one of two configurations. The first configuration is generally defined as a thumb or forward release type trigger, wherein the bow string is held in the forefingers, with the release in the palm of the hand and the trigger mechanism facing upwardly. When the thumb is pressed forward against the trigger, the sear is opened and the jaws are released for releasing the string. In the second configuration, the trigger mechanism operates in much the same manner as a firearm trigger, with the release being held in the palm of the hand and the trigger being disposed behind the index finger, wherein the release is unlocked when the trigger is squeezed by the index finger in a rearward direction, in the same manner as firing a pistol, rifle or other firearm. The particular trigger configuration selected is primarily a matter of choice. Some archers prefer the thumb-type or forward motion trigger whereas many others prefer the firearm-type or reverse motion trigger.

To date, there are no string release mechanisms which permit the archer to select a forward or reverse motion from a single mechanism. It would be desirable to provide such a mechanism since this would permit the archer to experiment with both types of trigger mechanisms without the expense of buying a plurality of bow string releases. Also, it would greatly enhance manufacturability of the string releases, permitting a single trigger mechanism be utilized for either a forward motion or a reverse motion string release.

As is also typical, most bow string releases are secured to the wrist of the archer, permitting the release to be held in an at ready position while, freeing the fingers of the hand for other tasks. Also, by attaching the release to the archer at the wrist area, the amount of strain on the hand is greatly decreased when high draw weight bows are utilized, which is typical in archery hunting and archery tournaments. Many various straps and harnesses are available for bow string releases. An example of a widely accepted V-type strap is shown in U.S. Pat. No. 4,831,997 entitled: Wrist Strap, issued to Greene, on May 23, 1989. Another example of a V-type strap is available from Martin Archery, Inc. in Walla Walla, Wash., known as the No. R-63 Quick-Silver Release, as illustrated in Archery Business, August/September 1988 issue. As there shown, the Quick-Silver Release includes an enlarged palm area to which the release is pivotally attached on an elongated, cylindrical shaft. The strap includes two ends which extend outwardly from the palm area and are adapted to be positioned around the wrist, after which one end is placed through a buckle about the wrist in the same manner as a belt would be attached about the waist.

The Greene release works in a similar fashion, with the two ends of the strap being placed around the wrist and then attached to secure the release strap and release to the wrist of the archer.

Another typical feature included in the No. R-63 Quick-Silver Release and as shown in a number of U.S. patents issued to Paul Peck and assigned to the present assignee, is the jaw action sear for closing and opening the string retaining notches. In most cases, a bearing element is positioned between the two jaws approximately in alignment with the pivot points thereof. The bearing element assures smooth, low friction action of the jaws as they are moved from the closed to the open position, assuring a good true line for the fired arrow. Many of these releases are self-closing with the string being placed in the space between the jaws and into the notch, after which it engages a closure abutment for locking the jaw in the closed position. The jaw is then not opened for releasing the string until the trigger mechanism is activated.

While there have been many advances in the string release art over the last several years, the strap mechanisms of the prior art require development of a certain amount of skill in order to properly place both ends of the strap over the wrist and secure the strap to a fastening means such as a belt buckle or the like. Also there are known no releases with dual action reverse and forward motion triggers. Finally, the jaws have not been substantially altered over the years, with most having a narrow opening for receiving the string and relying on a bearing element between the jaws adjacent to the pivot points in order to assure smooth firing. While these jaws have been acceptable from a functional standpoint, the addition of the bearing element greatly increases the cost of manufacture.

Therefore, there remains a need for a simple, quick mount release strap permitting the archer to readily mount the release on the hand and wrist. It is also desirable that the release permit the hand to be free for additional functions without requiring the removal of the wrist strap and release.

SUMMARY OF THE INVENTION

The subject invention is specifically directed to a bow string release having a new wrist strap attachment permitting a continuous, open loop to be formed, wherein the release may be secured to the wrist and positioned in the palm of the hand by sliding the hand through the loop and then cinching the strap to the desired tightened position. This greatly increases the efficiency with which the archer may place or mount the release on his wrist. In addition, because of the ability to precisely control the circumference of the strap about the wrist, repeatability of fit and comfort are also enhanced.

The bow string release is adapted to be attached to the wrist strap of the subject invention in such a manner as to permit adjustment of the distance between the trigger mechanism and the strap. In one embodiment, this is accomplished by providing a threaded shaft extending outwardly from the rear surface of the bow string release mechanism. An elongated, internally threaded stud is secured to the strap and is adapted for receiving the threaded shaft. The stud is secured to the strap in such a manner that it may be rotated about its axis without changing its longitudinal length relative to the shaft. By rotating the stud relative to the strap, the relative axial position of the release to the strap may be altered. This provides a desirable feature not available on prior art release and strap combinations, accommodating a variety of different sized hands on either the left or right hand, without sacrificing either the position of the trigger or the position of the wrist strap. In addition, the ability to swing the release along side the archer's wrist/hand on either side permits free and clear use of that hand without removing or adjusting the position of the wrist strap.

In an alternative embodiment, the adjusting mechanism includes an outer sleeve having a center bore of sufficient size to accommodate a threaded shaft. An internally threaded member is positioned in and secured in the sleeve and adapted for engaging the threads on the shaft. The sleeve is secured to the strap and the shaft is secured directly to the release. By rotating the shaft relative to the sleeve, the relative position of the release and strap may be adjusted.

It is another important feature of the invention to provide a release strap which permits the release to be moved out of the firing position and out of the way of the hand and palm to permit free use of the hand without removing the wrist strap. In one embodiment the finger grip portion of the release is pivotally mounted to the strap, permitting the release to swing or pivot out of the way. In another embodiment of the invention, the finger grip is attached to the strap with a hinged portion between the release and the strap, permitting the release and finger grip to be folded back over the wrist and out of the way. In the preferred embodiment, a live hinge is utilized, and a tab is provided to act as an over-center catch to hold the release in the stowed position.

It is, therefore, an object and feature of the subject invention to provide a wrist strap having a permanent loop construction for facilitating positioning of the strap on the wrist for securing the release.

It is also an object and feature of the subject invention to provide a bow string release attached to a wrist strap, wherein the position of the release relative to the strap is adjustable for accommodating varying size hands without sacrificing the position of the trigger or the position of the strap around the wrist, with a contoured edge to both fit into the palm of the hand and provide an edge adapted for gripping when pulling the bow string back.

It is also an object and feature of the subject invention to provide means for stowing the release in an out of the way position to permit use of the hand without removing the wrist strap.

Other objects and features of the invention will be readily apparent from the accompanying drawings and detailed description.

DETAILED DESCRIPTION OF THE PREFERRED EMBODIMENT

Figure 1:
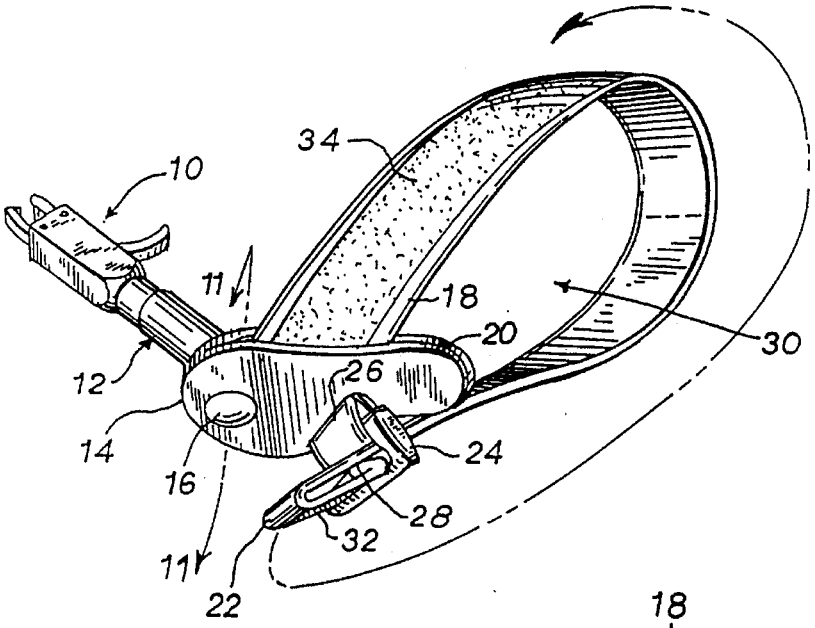
FIG. 1 is a perspective view of a bow string release and wrist strap combination in accordance with the subject invention.
Figure 2:
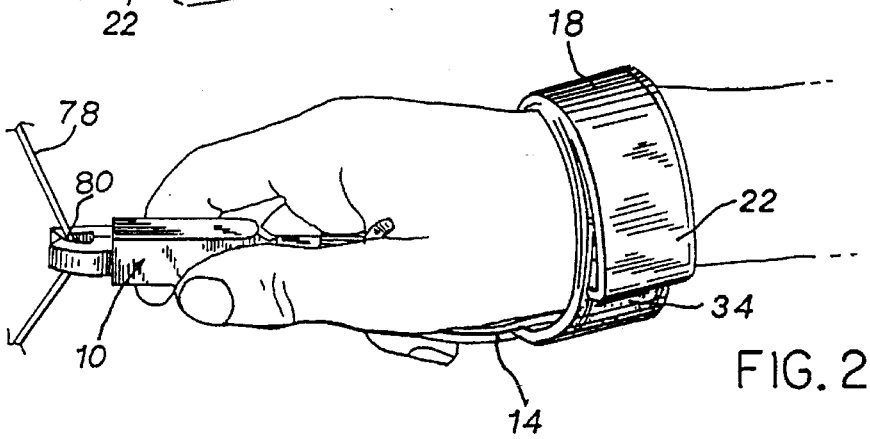
FIG. 2 is an illustration of the release of FIG. 1 as attached to the wrist of an archer and with the release in the firing position.
Figure 3:
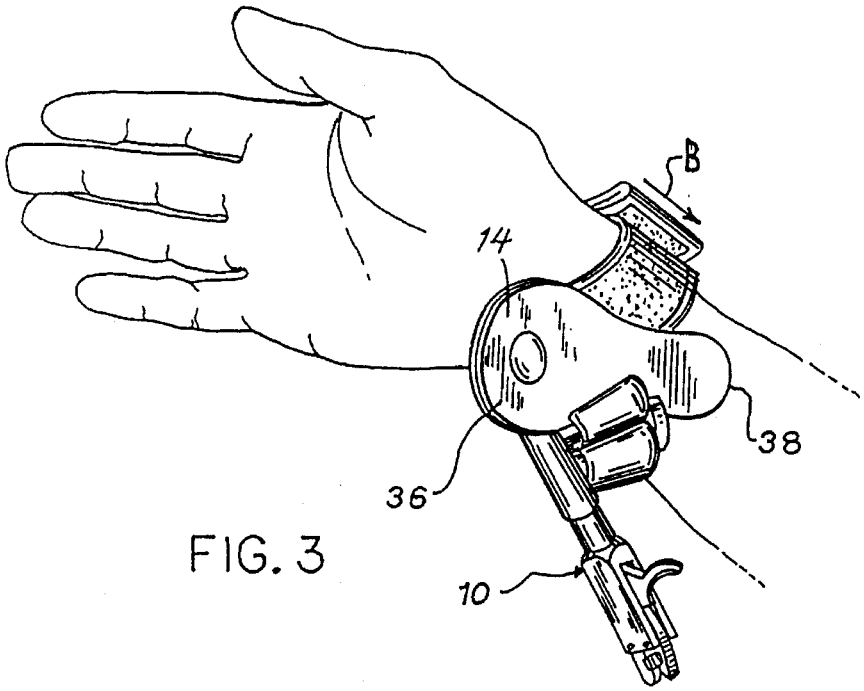
FIG. 3 is a view of the release and wrist strap combination as attached to the wrist of the user, with the release in an at rest position.

As shown in FIGS. 1–3, the wrist strap and release combination of the subject invention includes a release mechanism 10 secured to a rotatable shaft 12 which is in turn secured to the base 14 of a wrist strap, as depicted by the fastener 16. The wrist strap base 14 includes an elongated pad having a strap member 18 extending outwardly from the upper edge 20 and looping around behind the base 14, with an outer end 22 as shown in FIG. 1. A buckle 24 or other fastener means is secured to the base 14 via a loop 26. It will be readily understood by those who are skilled in the art that other means for securing the strap 18 and the buckle 24 to the base 14 could be utilized without departing from the scope and spirit of the invention.

In the embodiment of FIGS. 1–3, the buckle 24 has a center post (not shown) for creating a rectangular opening 26 adapted for receiving the strap 18. The outer end 22 of the strap 18 is folded back over itself and stitched or otherwise secured as shown at 28 to assure that the outer end 22 of the strap cannot readily pass back through the buckle 24 after it has been inserted therethrough. This provides a continuous open loop 30, as clearly shown in FIG. 1. In order to place the wrist strap on the hand of the archer as shown in FIG. 2, the archer simply slips his fingers and hand through the loop 30, and grasps the release 10 as shown in FIG. 2, with the base 14 of the strap properly positioned in the back of the hand, beneath the thumb and wrist area. The outer strap 18 then is positioned behind the thumb, where it encircles the wrist. By grasping the outer end 22 of the strap 18, and pulling it through the buckle 24, the strap is tightened about the wrist. In the preferred embodiment, the outer end 22 of the strap includes a fastener pad 32 such as a Velcro brand or other type hook and loop fastener system. The outer surface of the strap 18 includes a complementary fastener pad or strip 34 which is adapted for receiving and securing the fastener pad 32 in any of an infinite variety of positions, for securely tightening the strap 18 about the wrist, as shown in FIG. 2. As is best shown in FIG. 3, the base 14 of the strap member is of a "tear drop" shape, having a wide front portion providing a contoured front edge 39 to grip when pulling the bow and for securely holding the release 10, and a narrowing rear portion 38 shaped to fit the palm of the hand for permitting better flexing of the thumb and palm and wrist once the release has been secured to the hand. Additionally, the "tear drop" shape holds the release up in easy reach when not in a quick access position.

Figure 11:
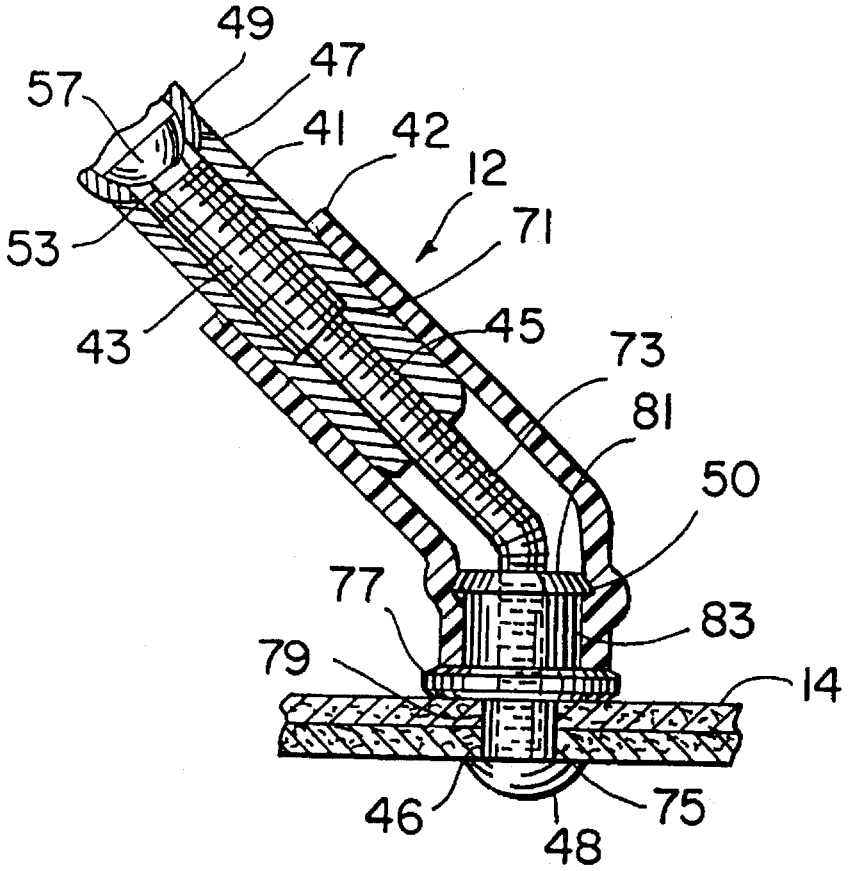
FIG. 11 is a fragmentary, longitudinal cross-section of an alternative adjustment mechanism as used with the strap embodiment of FIGS. 1–3.

As is best shown in FIG. 11, the shaft assembly 12 includes an adjusting sleeve 41. The adjusting sleeve 41 has a large threaded central bore 43 at one end thereof and a small threaded central bore 45 at the opposite end thereof. The outer end 47 of the large threaded bore 43 includes a radius for receiving the convex end 49 of the body of the release. The adjusting sleeve 41 is secured to the body via a screw or pin member 53 which, in the preferred embodiment, is a swivel screw having a threaded shaft and a convex head 57. The convex head 57 is adapted to be received in an arcuate socket 49 provided in the body of the release.

The arcs defining the convex head 57, the socket 49, and the radial arc end 47 of the adjusting sleeve are in concentric and axial alignment with one another, respectively, permitting the release body 10 to tilt relative to the axis of the adjusting sleeve 41, permitting further fine adjustment of the position of the string release 10 relative to the shaft assembly 12 and the strap assembly 14. Thus, the strap assembly for securing the release 10 to the wrist permits both rotational and tilting adjustment of the release relative to the strap.

It will be noted that the swivel screw 53 includes a hollow, central clearance bore 71 adapted for receiving the adjusting rod 73. The adjusting rod 73 passes through the clearance bore 71 of the screw and through the large bore 43 of the adjusting sleeve and is threadably received in the small threaded bore 45 of the sleeve (FIG. 11). The one end of the adjusting rod extends beyond the end of the adjusting sleeve 41 and is secured in a swing adapter member 50.

The swing adapter member 50 includes a lower end comprising a cylindrical shaft 75 and a central base enlarged circular flat base 77. The shaft 75 is adapted to pass through the clearance hole 46 provided in both layers of the base pad 14 of the string release. A headed screw 48 is then threadably received in the threaded central bore 79 of the swivel adapter for sandwiching the base 14 between the head and the swing adapter base 77.

The upper end of the swing adapter 50 includes an enlarged cylindrical shaft 83 with a protruding, tapered lip or barb 81 at its outer end. The extended end of the adjusting rod 73 is threadably received in the bore 79 of the swing adapter and is tightened therein for securely holding the adjusting rod relative to the base 14 of the strap.

In order to alter the position of the release 10 relative to the strap base 14, the adjusting sleeve 41 is rotated to axially advance or retract it along the adjusting rod 73. The release 10 moves in unison with the adjusting sleeve 41 since it is secured thereto via the swivel screw 53.

In order to assure against incidental rotation of the adjusting sleeve 41 relative to the adjusting rod 73, a resilient, tight fitting outer sleeve 42 is secured to the adjusting sleeve as shown in FIG. 11 and extends downwardly over the enlarged shaft portion 83 of the swing adapter 50. The outer barb 81 of the swing adapter 50 stretches and tightly grips the resilient sleeve 42, assuring against incidental rotation of the adjusting sleeve relative to the adjusting rod and the swing adapter.

As can be seen in FIG. 3, by utilizing the assembly as previously described for securing the shaft 12 to the strap base 14, the entire release 10 and shaft assembly 12 can be pivoted downwardly or upwardly out of the firing position, moving the release to a position along side the wrist and hand on either side and releasing the hand for other functions without removing the strap 18 from the wrist. As also can be seen by FIG. 3, where desired the wrist strap can be retracted slightly away from the wrist in the direction of arrow B without removing the wrist strap from the archers wrist and hand area. This greatly facilitates use of the hand while keeping the release mechanism in an at ready position.

Figure 4:
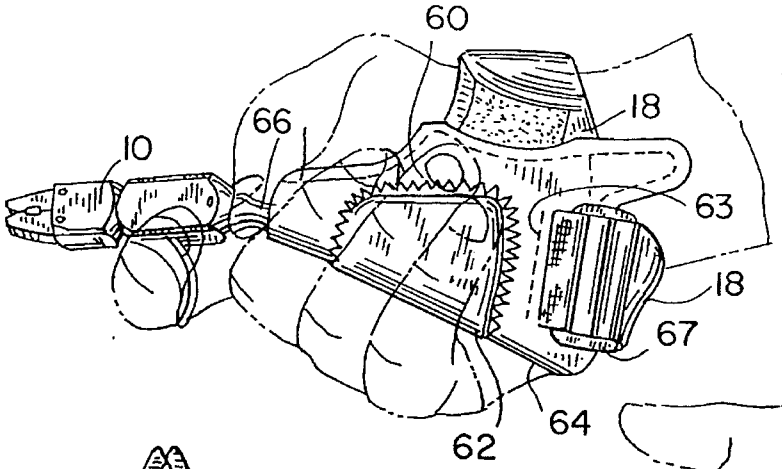
FIG. 4 is a perspective view of an alternative embodiment of the release strap, incorporating a live hinge stowing mechanism, showing the release in the firing position.
Figure 5:
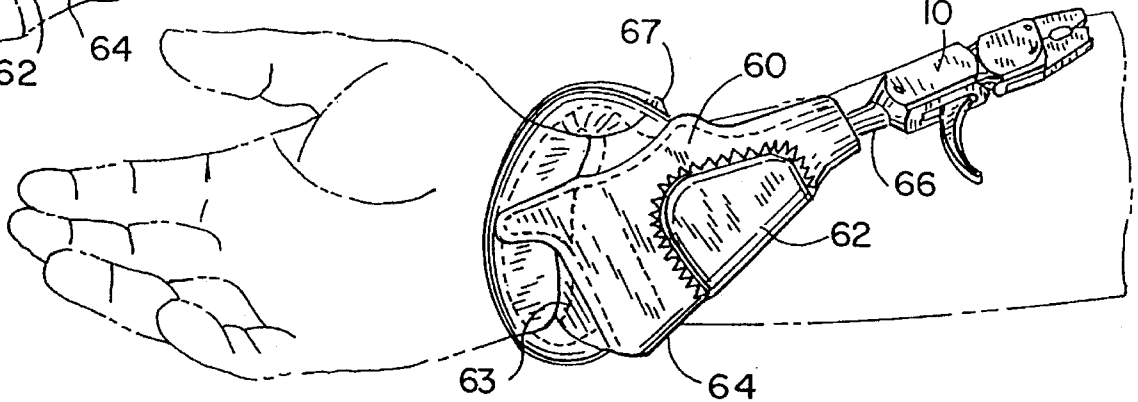
FIG. 5 is a view looking in the same direction as FIG. 4, showing the release in the stowed position.
Figure 6:
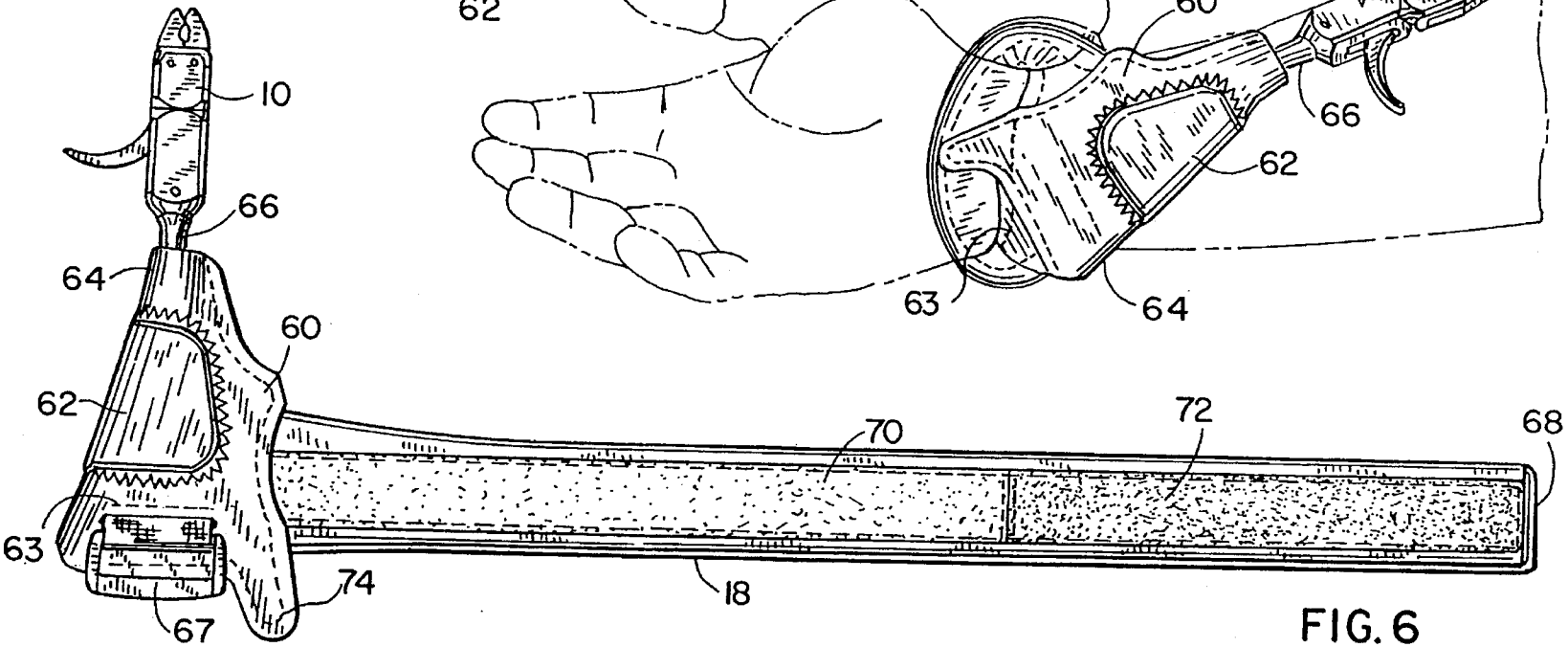
FIG. 6 is a view of the wrist strap assembly of the alternative embodiment shown in FIGS. 4 and 5.
Figure 7:
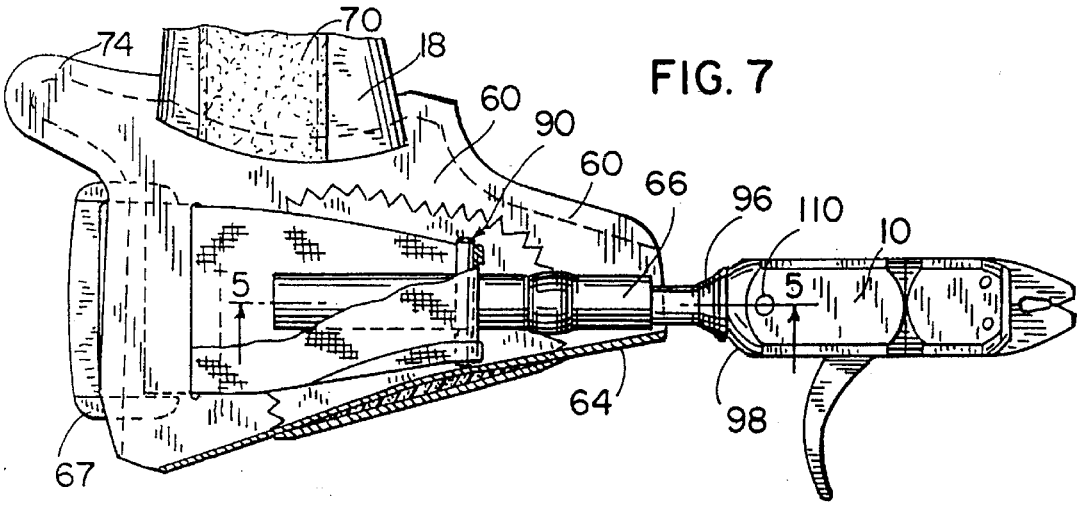
FIG. 7 is an enlarged, partially cut-away view of the assembly of FIG. 6, showing the release attachment mechanism.

An alternative, preferred embodiment of the strap and adjustment mechanism is shown in FIGS. 4–10. As specifically shown in FIG. 6, the strap assembly incudes a base 60 having a cushioned finger pad 62. The elongated strap 18 is secured to the base 60 along a single stitch line 63. In the preferred embodiment, the base is a single layer piece made of a durable material such as leather. It is folded at 64 to surround or envelop the release mounting sleeve 66 (see FIG. 7). As best shown in FIGS. 4 and 6, the base is shaped to be comfortably positioned in the palm of the hand with the finger pad 62 positioned to be firmly gripped by the fingers in a clenched position.

A loop/retainer 67 is secured to the base 60 at the end opposite the release 10. As shown in FIGS. 4 and 6, the outer end 68 of strap 18 is placed through the loop 67 for securing the strap about the wrist. Where desired, the outer end 68 may be enlarged to permanently retain the strap in the retainer 67 for defining a permanent loop as in the embodiment of FIGS. 1–3.

In the preferred embodiment, the strap includes a hook and loop type fastener system. As best shown in FIG. 6, the strap 18 includes a first fastener pad 70 adjacent the base 60 and a second, complementary pad 72 adjacent the outer end 68. When the loop is placed over the wrist as shown in FIG. 4, with the strap through the retainer 67, the strap may be cinched about the wrist and secured by placing pads 70 and 72 into securing contact with one another. This makes the strap infinitely adjustable about the wrist, permitting the archer to mount the strap adjusted to his/her personal comfort.

An important feature of the subject invention is the ability to place the release 10 in an out-of-the-way position without removing the release strap from the wrist, as shown in FIGS. 3 and 5. In the embodiment of FIGS. 4–6, this is provided by incorporating a live hinge in the base 60. In the preferred embodiment, the live hinge is defined by the single stitch line 63. As shown in FIG. 5, the pad 60 and release 10 are adapted to be folded back over the wrist and out of the way. In the preferred embodiment, the pad 60 includes a tab 74 extending outwardly from the pad and the release. The tab 74 acts as a "stop" or an over-center latch to hold the release 10 and the pad 60 in the position of FIG. 5, when stowed. As best seen in FIG. 4, the tab 74 is positioned such that it does not interfere with the archer's hand movements when the release is in the firing position.

Figure 8:
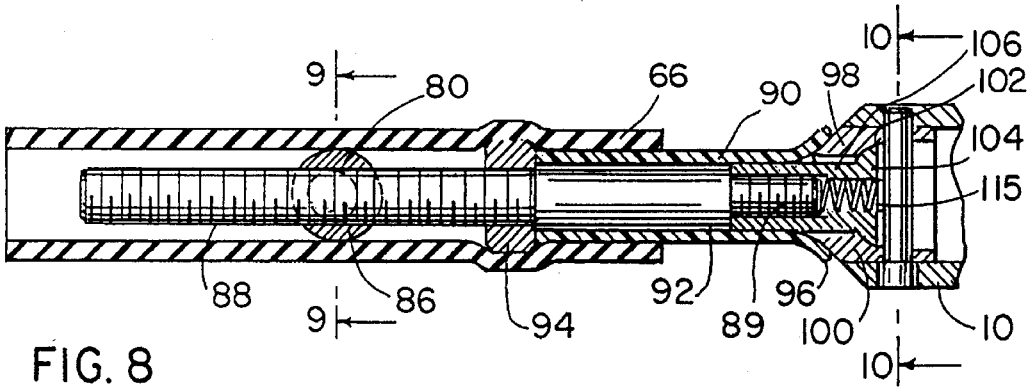
FIG. 8 is a fragmentary longitudinal cross-section showing the adjustment mechanism of the alternative embodiment.
Figure 9:
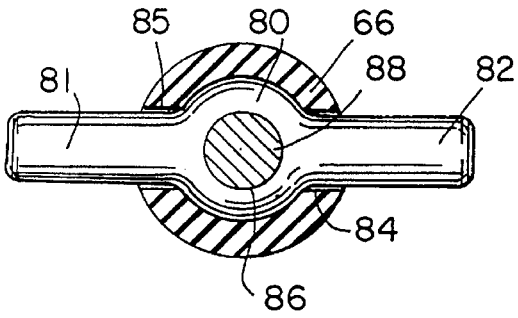
FIG. 9 is a section view taken at line 9—9 of FIG. 8.

An alternative adjustment mechanism for adjusting the position of the release 10 relative to the pad 60 is shown in FIGS. 7–10. As there shown, the sleeve 66 is carried in the folded pad 60. As shown in FIGS. 8 and 9, a mounting yoke 80 is carried in the sleeve and includes outward extending arms 81 and 82. In the preferred embodiment, the sleeve 66 is made of a resilient material and includes a pair of radially extending through holes 83, 84 for receiving the arms 81, 82, respectively. The sleeve is adapted to be stretched over and fitted onto the arms. The yoke 80 includes an internally threaded central bore 86 adapted for receiving the mated threaded shaft 88. The arms of the yoke 80 are secured directly to the pad 60, as shown at 91, see FIG. 7.

As best seen in FIG. 8, the release end of the shaft 88 is mounted in a tube 90. The shaft may be fixedly secured to the tube by any well known manner. In the preferred embodiment, the tube includes a fixed, threaded cylinder 92 for receiving the shaft 88 and a stop nut 94 is provided for locking the shaft relative to the tube and cylinder. The release end 96 of the tube 90 is flanged outwardly (see also FIG. 7). The release end 96 receives the spherical end 98 of the release mounting piece 100. The release mounting piece has a hollow core with a seat 102 for receiving the head 104 of a fastener 106. In the preferred embodiment, the fastener 106 includes an internal bore 108 which is adapted to threadably receive the release end 89 of the shaft 88, for holding the mounting piece on the end of tube 90.

Figure 10:
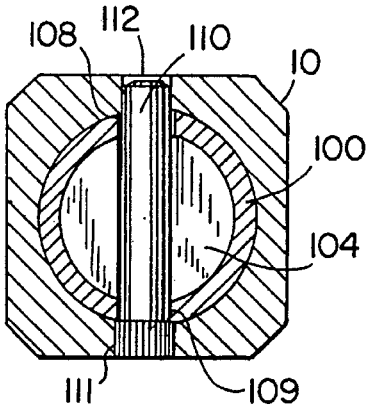
FIG. 10 is a section view taken at line 10—10 of FIG. 8.

As best shown in FIG. 10, the mounting piece 100 includes a pair of diametrically opposed through holes 108, 109 for carrying a mounting post 110. The mounting post 110 is adapted to be placed through mounting holes 111, 112 provided in the release 10 and likewise, through mounting holes 108, 109 in the mounting piece.

In the preferred embodiment, the post 112 defines a pivot pin, permitting the release 10 to pivot relative to the fastener 106. In addition, the spherical end of the mounting piece 98 may "wobble" in the flanged tube end 96, permitting the release 10 to be angularly adjusted for comfort. In order to provide resistance against undesirable movement, a compression spring 115 is placed between the end 89 of shaft 88 and the post 110.

The relative position of the release 10 to the pad 60 may be adjusted by turning the release assembly (including the release 10, the mounting piece 98, the tube 90 and the shaft 88) in yoke 80. As the assembly is rotated, the shaft 88 moves axially relative to the yoke 80 and hence the pad 60, permitting the archer to adjust the position of the release to comfort.

While specific features and embodiments of the invention have been described in detail herein, it will be readily understood that the invention encompasses all modifications and enhancements within the scope and spirit of the following claims.

What is claimed is:

1. A wrist strap for a bow string release for selectively securing and releasing the string of a bow for firing an arrow therefrom, the release of the type having a body which is adapted to be mounted on the wrist strap for attaching the release body selectively positioned to facilitate firing, the wrist strap comprising:

a. a base area;

b. means for securing the release to the base area;

c. a strap secured to the base area and adapted for securing the strap about the wrist with the release normally positioned in a firing position;

d. means for tightening the strap in place about the wrist; and e. wherein the strap is made of a material of sufficient flexibility for permitting the base area and release to be moved away from the palm and out of the firing position without removing the strap from the wrist.

2. The wrist strap of claim 1, wherein the means for tightening is a strap retainer comprising a loop adapted for receiving the outer end of the strap therethrough, whereby the strap may be selectively tightened about the wrist by pulling the strap through the retainer.

3. The wrist strap of claim 2, wherein the strap includes a strap fastener for releasably securing the strap in its tightened position about the wrist.

4. The wrist strap of claim 2, wherein the outer end of the strap incudes an outer tip of sufficient size to preclude the passage of the outer end of the strap through the loop once the strap has been assembled, whereby the elongated strap defines a continuous loop in both the loosened and tightened positions.

5. The wrist strap of claim 1, wherein the means for securing is movably secured to the strap base area, whereby the release may be selectively swung into and out of firing position.

6. The wrist strap of claim 5 wherein the means for securing is a release coupler.

7. The wrist strap of claim 6 wherein the release coupler includes a telescoping member attached to the release.

8. The wrist strap of claim 1, wherein the base area is made of a two plies secured in overlying relationship with one another and wherein the inner end of the elongated strap is secured between the two plies.

9. The wrist strap of claim 1, wherein the means for securing is adapted for securing the release to the strap between the base area and the palm of the hand wherein the release is in the firing position.

10. The wrist strap of claim 1, further including a tab stop secured to and extending from the base area for selectively retaining the base area in a selected position relative to the strap.

11. The wrist strap of claim 1, wherein the base area is constructed of a semi rigid material adapted for holding its general shape but sufficiently flexible to conform to the general contours of the palm of the hand.

12. The wrist strap of claim 1, wherein the base area is a generally tear-drop shape with the wide end of the tear-drop adapted for receiving the release and the narrow end of the tear-drop adapted for being positioned beneath and in non-interfering relationship with the thumb when the base area is positioned in the palm with the release in the firing position.

13. The wrist strap of claim 12, wherein the tear-drop base area includes a forward edge contoured to provide a finger grip for gripping and securing the base area when drawing a bowstring.

14. The wrist strap of claim 1, wherein the base area is of a shape generally conforming to the shape of the palm and includes a finger grip area adapted to be engaged by the fingers of the hand, the base area further including a cushioned pad over the finger grip area.

15. The wrist strap of claim 1, wherein the means for tightening the release in place about the wrist comprises a hook and loop type fastener positioned adjacent the outer end of the strap.

16. The wrist strap of claim 1 wherein the base area is an element separate from the strap.

17. The wrist strap of claim 1, wherein the base area is a generally tear-drop shape with the wide end of the tear-drop adapted for receiving the release and the narrow end of the tear-drop adapted for being positioned beneath and in non-interfering relationship with the thumb when the base area is positioned in the palm with the release in the firing position.

18. The wrist strap of claim 17, wherein the tear-drop base area includes a forward edge contoured to provide a finger grip for gripping and securing the base area when drawing a bowstring.

19. The wrist strap of claim 1, the strap is an elongated strap having opposite outer ends, one outer end of the strap secured to the base and the other outer end of the strap adapted for encircling the wrist, and wherein the means for tightening the strap comprises a retainer on the base area for receiving the outer end of the strap for defining an open, continuous loop comprising the base, strap and fastener, whereby the release and the strap may be secured to the hand mid wrist.

* * * * *

UNITED STATES PATENT AND TRADEMARK OFFICE

CERTIFICATE OF CORRECTION

PATENT NO. : 5,615,662

DATED : April 1, 1997

INVENTOR(S) : Lynn Tentler et al.

It is certified that error appears in the above-identified patent and that said Letters Patent are hereby corrected as shown below:

In FIG. 9 of the Drawings, delete the reference numeral "85" and substitute therefor --- 83 ---

Column 1, Line 25, Delete "4,403,584" and substitute therefor --- 4,403,594 ---

Column 4, Line 66, Delete "39" and substitute therefor --- 36 ---

Column 6, Line 10, Delete "incudes" and substitute therefor --- includes ---

Column 6, Line 63, Delete "91" and substitute therefor --- 90 ---

Column 7, Claim 4, Line 2, Delete "incudes" and substitute therefor --- includes ---

Column 8, Claim 8, Line 2, Delete "a" before "two"

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*